US005934923A

United States Patent [19]

Matsuoka et al.

[11] Patent Number: 5,934,923

[45] Date of Patent: Aug. 10, 1999

[54] TERMINAL METAL FITTING ASSEMBLING STRUCTURE

[75] Inventors: Hiroyuki Matsuoka, Yokkaichi; Nobuhiro Takada, Toyota, both of Japan

[73] Assignees: Sumitomo Wiring Ststems, Ltd., Yokkaichi; Toyota Jidosha Kabushiki Kaisha, Toyota, both of Japan

[21] Appl. No.: 08/819,268

[22] Filed: Mar. 18, 1997

[30] Foreign Application Priority Data

Apr. 22, 1996 [JP] Japan ..... 8-099853

[51] Int. Cl.[6] ..... H01R 11/12

[52] U.S. Cl. ..... 439/287; 439/883

[58] Field of Search ..... 439/287, 288, 439/883, 907, 431–433

[56] References Cited

U.S. PATENT DOCUMENTS

| | | | |
|---|---|---|---|
| 3,002,173 | 9/1961 | Allen | 439/883 |
| 4,943,247 | 7/1990 | Wise | 439/883 |
| 4,950,186 | 8/1990 | Kaley et al. | 439/883 |
| 4,968,268 | 11/1990 | Oh | 439/431 |

FOREIGN PATENT DOCUMENTS

| | | |
|---|---|---|
| 0-318-844 | 6/1989 | European Pat. Off. . |
| 0-670-612 | 9/1995 | European Pat. Off. . |
| 0-777-299-A2 | 6/1997 | European Pat. Off. . |
| U-4-121669 | 10/1992 | Japan . |
| U-5-31122 | 4/1993 | Japan . |
| 7-85913 | 3/1995 | Japan . |
| U-7-32863 | 6/1995 | Japan . |
| U-7-32864 | 6/1995 | Japan . |
| A-7-263043 | 10/1995 | Japan . |
| 8-203587 | 8/1996 | Japan . |
| 1080763 | 8/1967 | United Kingdom . |

*Primary Examiner*—Neil Abrams
*Attorney, Agent, or Firm*—Oliff & Berridge, PLC

[57] ABSTRACT

In a terminal metal fitting assembling structure (10,30), a projecting portion (45) is provided on a plate-like overlap portion (32) which is formed on a second terminal metal fitting (30). In addition, the position of the projecting portion (45) is set outside an area (A) of the overlap portion (32) that is overlapped by a head portion (50A) of a tightening bolt (50). Due to this, when the terminal metal fittings (10,30) are tightened by the tightening bolt (50), a plate-like overlap portion (12) formed in the first terminal metal fitting (10) is flexibly deformed and is pressed by the projecting portion (45) against the plate-like overlap portion (32) of the second terminal metal fitting (30), so that the two terminal metal fittings (10,30) can be strongly contacted with each other by the resilient force generated by the flexibly deformed plate-like overlap portion (12). This makes it possible to increase the contact pressure between the two terminal metal fittings. Still further, since the projecting portion (45) is not tightened directly, even if the two terminal metal fittings are tightened excessively by the tightening bolt, the projecting portion (45) can be prevented from being crushed.

7 Claims, 4 Drawing Sheets

TERMINAL METAL FITTING ASSEMBLING STRUCTURE

BACKGROUND OF THE INVENTION

1. Field of the Invention

The present invention relates to a terminal metal fitting assembling structure which is able to bring a plurality of terminal metal fittings into contact with each other by use of a bolt or the like.

2. Description of the Related Art

For example, when a plurality of ground terminals individually connected to a plurality of equipments are to be mounted onto a vehicle body, there is conventionally used a structure in which the ground terminals are assembled together into an integral assembly in such a manner that they are overlapped with each other and, after then, the assembly is fixedly fastened to the vehicle body by use of a bolt. In such structure, by tightening the bolt, not only the ground terminals can be closely contacted with the vehicle body but also the ground terminals can be closely contacted with each other. Due to such close contact between the ground terminals, even the ground terminals that are not in direct contact with the vehicle body are also allowed to be in indirect conduction with the vehicle body.

However, in the above-mentioned conventional structure, since contact between the ground terminals simply consists of the surface contact thereof, the terminal metal fittings of the ground terminals must be fastened strongly until they are closely contacted with each other, in order to be able to secure conduction between the ground terminals. In other words, in the conventional structure, even if the bolt is loosened only slightly, there is a fear of worsening the conduction of the ground terminals not in direct contact with the vehicle body.

SUMMARY OF THE INVENTION

The present invention aims at eliminating the above-mentioned drawbacks found in the conventional terminal metal fitting assembling structure. Accordingly, it is an object of the invention to provide a terminal metal fitting assembling structure which can secure contact reliability between the terminal metal fittings assembled together.

A terminal metal fitting assembling structure includes: a plurality of terminal metal fittings including a first terminal metal fitting and a second terminal metal fitting, the second terminal metal fitting having a projecting portion on a first surface thereof opposing to the first terminal metal fitting to form a clearance between the first and second metal fittings when the first and second metal fittings are overlapped; and a tightening member which fastens the metal fittings so that the first and second metal fittings are maintained in contact with each other; wherein the tightening member tightly fastens areas of the first and second metal fittings situated inside of the projecting portion to flexibly deform the second terminal metal fitting to approach the first and second metal fittings each other, so that the projecting portions are contacted with the first metal fitting with a resilient force.

According to the invention, to assemble the terminal metal fittings together, at first, the terminal metal fittings are overlapped with each other. In this case, since the projecting portions are projectingly provided on the mutually opposed surfaces of the terminal metal fittings, the two terminal metal fittings are overlapped with each other through the projecting portions while forming a clearance between them. In this state, if the areas of the terminal metal fittings that are situated inside the projecting portions are fastened tight together, then the terminal metal fittings, that is, the clearance forming portions thereof are flexibly deformed in a direction where they are made to approach each other, whereas there is generated a resilient force in the portions of the terminal metal fittings against which the projecting portions are butted. That is, since the two terminal metal fittings are in contact with each other through the projecting portions, reliability on the assembled condition of the two terminal metal fittings can be enhanced. Also, because the tightening member fastens tight the portions of the terminal metal fittings inside the pressing portions but does not tighten the projecting portions directly, even if the terminal metal fittings are fastened excessively tight, the pressing portions can be prevented from be deformed, damaged and the like.

BRIEF DESCRIPTION OF THE DRAWINGS

The nature, utility and principle of the invention will be more clearly understood from the following detailed description and the appended claims when read in conjunction with the accompanying drawing. In the accompanying drawings:

DETAILED DESCRIPTION OF THE INVENTION

Now, description will be given below of an embodiment of a terminal metal fitting assembling structure according to the invention with reference to FIGS. 1 to 5.

In the description of the present embodiment, the invention is applied to a ground terminal metal fitting assembling structure in which two terminal metal fittings are assembled together and the resultant assembly is then mounted onto the body of a vehicle.

Figure 1:
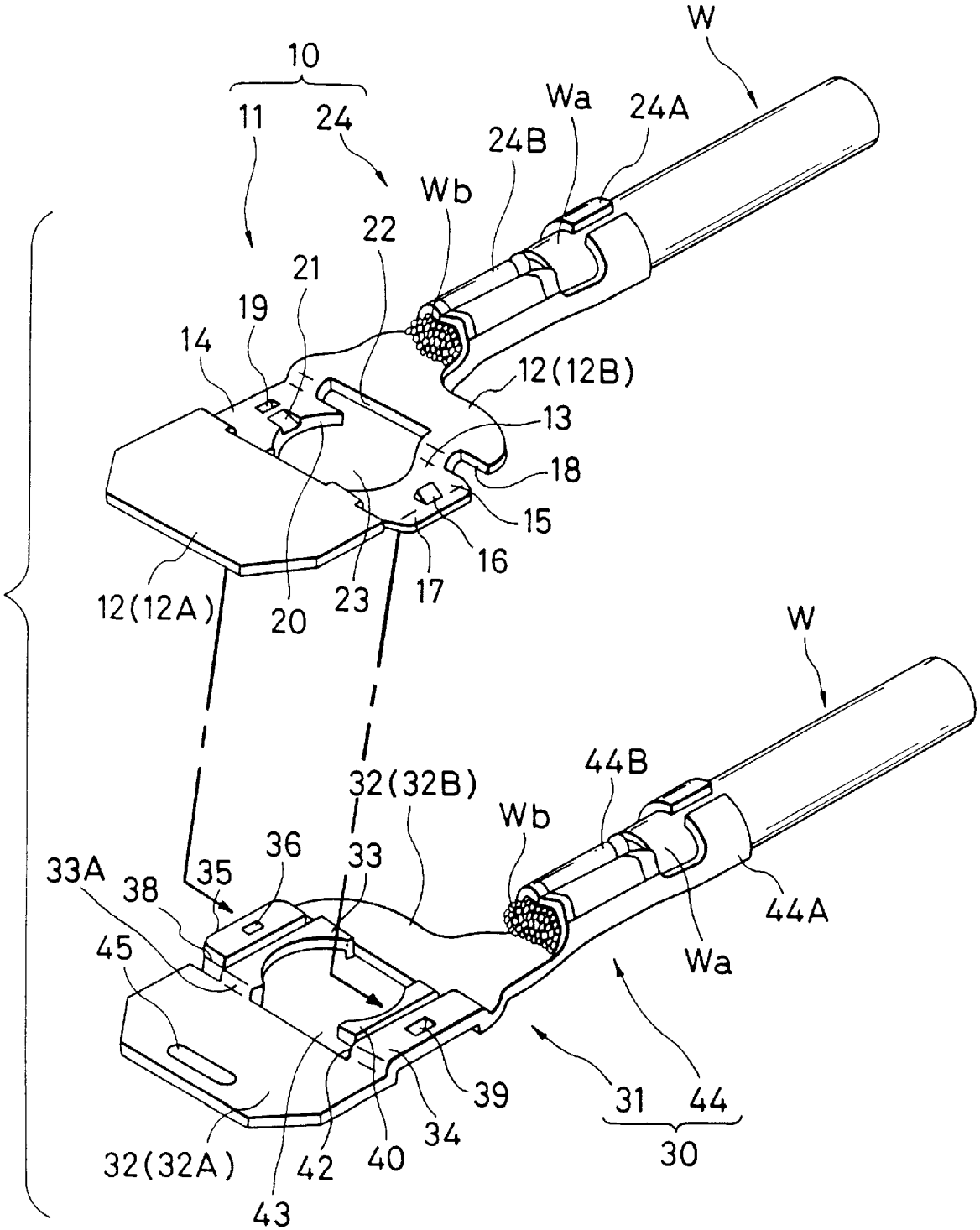
FIG. 1 is a perspective view showing two terminal metal fittings in a condition that they are separated from each other, in an embodiment of a terminal metal fitting structure according to the invention.
Figure 2:
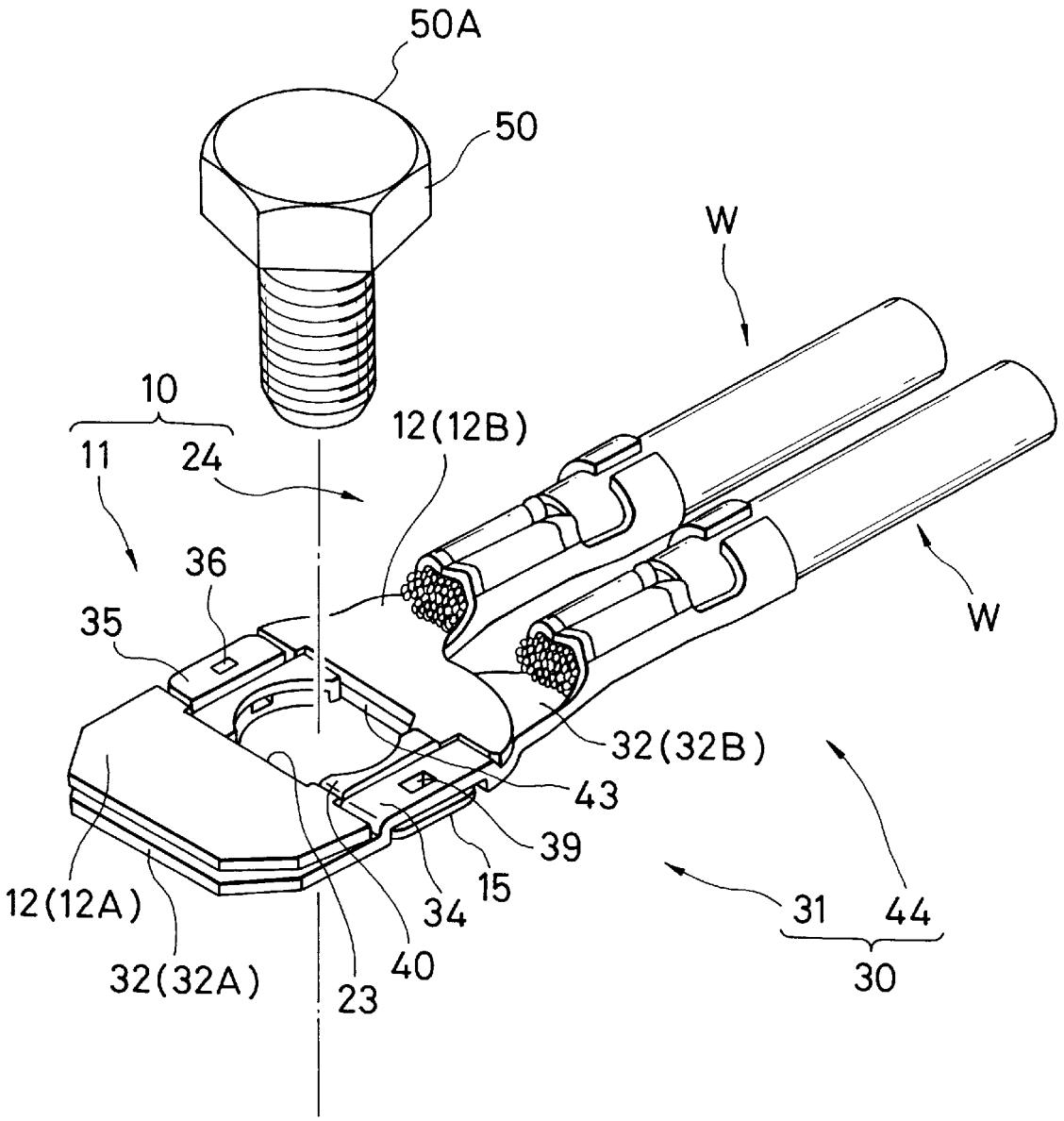
FIG. 2 is a perspective view showing the two terminal metal fittings in a condition that they are assembled together, and a tightening bolt.
Figure 3:
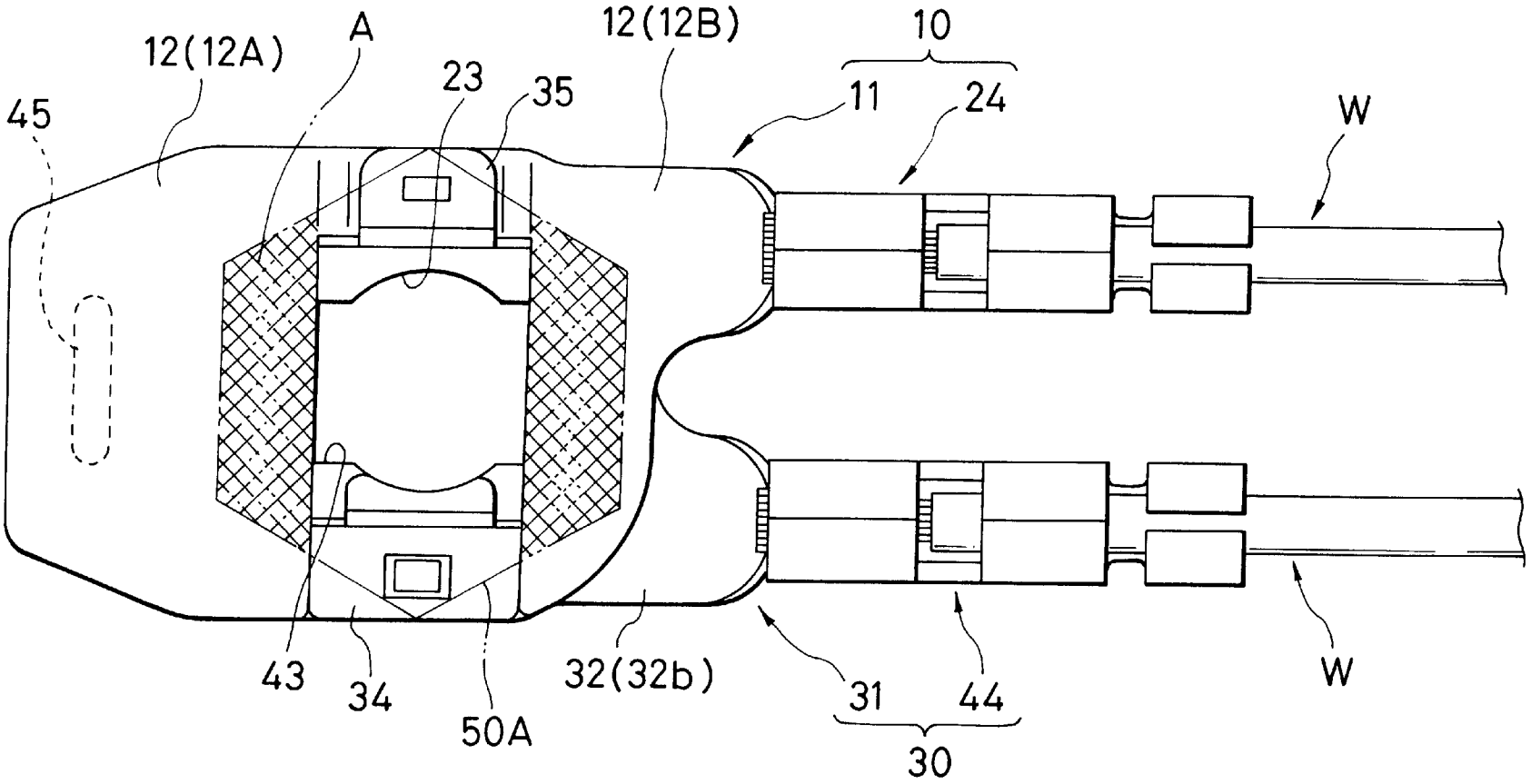
FIG. 3 is a top plan view of the two assembled terminal metal fittings, showing a position where a projecting or pressing portion is provided.
Figure 4:
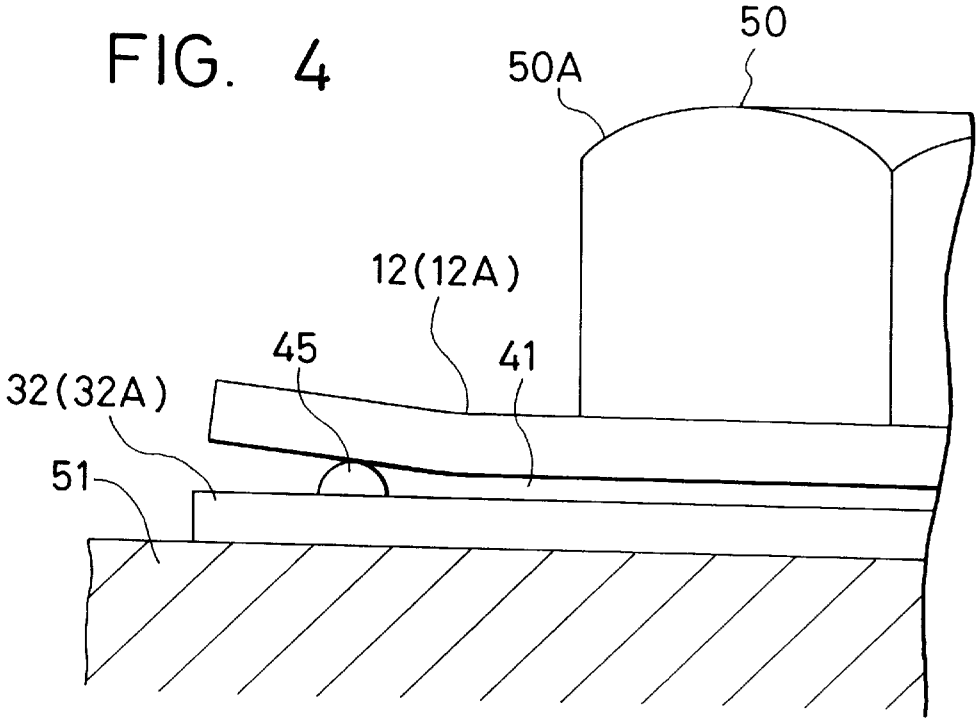
FIG. 4 is a partially enlarged side view of plate-like overlap portions provided in the two terminal metal fittings, showing the flexibly deformed condition of the overlap portions; and, FIG. 5 is a partially enlarged side view of the two terminal metal fittings, showing the assembled condition thereof.
Figure 5:
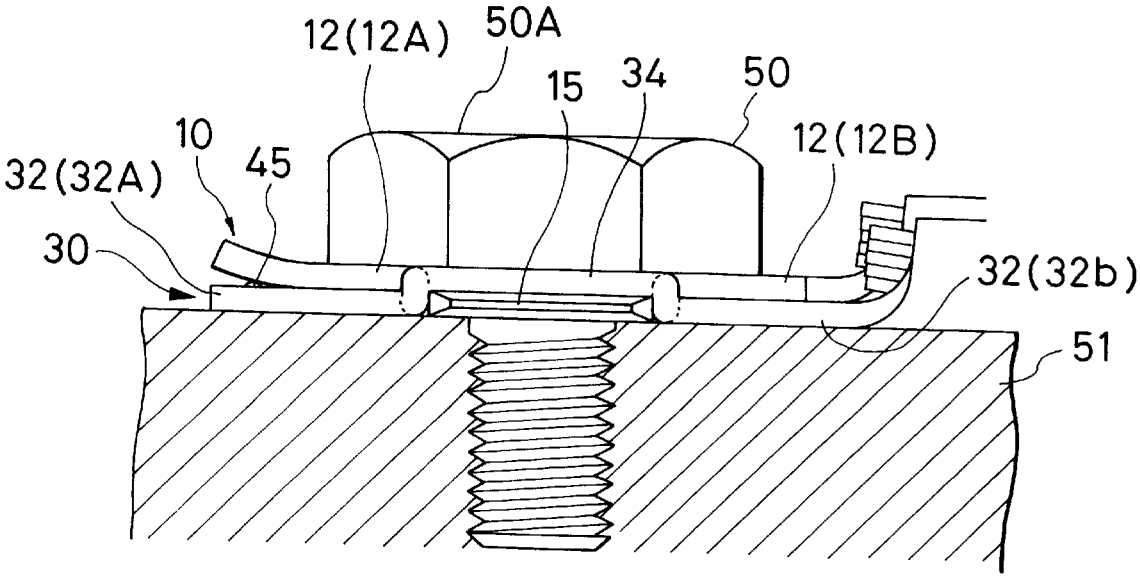

In the assembling structure according to the present embodiment, there are used two kinds of terminal metal fittings: that is, one is a first terminal metal fitting 10 which is shown in the upper portion of FIG. 1; and, the other is a second terminal metal fitting 30 shown below of the first terminal metal fitting 10 FIG. 1.

(Structure of First Terminal Metal Fitting)

To form the first terminal metal fitting 10, a conductive metal plate is punched out into a given shape and, after then, the punched metal plate is bent; and, the first terminal metal fitting 10 includes an assembling portion 11 and an electric wire connecting portion 24. The assembling portion 11 includes a plate-like overlap portion 12 composed of two flat plates arranged in parallel to each other but spaced apart from each other (hereinafter, a plate-like overlap portion disposed on far side to the electric wire connecting portion 24 in FIG. 1 is referred to as 12A, while a plate-like overlap portion disposed on the near side thereto in FIG. 1 is referred to as 12B), a plate-like securing portion 13 which is disposed between the respective one-side end portions of the two plate-like overlap portions 12A and 12B in such a manner that the securing portion 13 spans the two overlap portions 12A and 12B, and a plate-like receive portion 14 disposed between the respective end portions of the two plate-like overlap portions 12A and 12B opposite to the above-mentioned end portions thereof for the securing portion 13 in such a manner that the receive portion 14 spans the two overlap portions 12A and 12B. The plate-like two overlap portions 12A and 12B are set flush with each other, while the plate-like overlap portion 12A is formed slightly wider than the plate-like overlap portion 12B on the leading end side thereof (in FIG. 1, on this side). Also, the securing portion 13 and receive portion 14 are set flush with each other are also set at a height which is lower than the two plate-like overlap portions 12A and 12B by an amount substantially equal to the plate thickness of the plate-like overlap portion 12A or 12B.

In the securing portion 13, there is formed a displacement restriction portion 15 which is set flush with the securing portion 13 and extends out in the opposite direction of the receive portion 14. And, on the upper surface of the displacement restriction portion 15, there is formed a securing claw 16 by cutting and raising the same upper surface, which securing claw 16 can be engaged with a securing hole 39 formed in a second terminal metal fitting 30 to be discussed later. Also, in the leading end edge of the displacement restriction portion 15, there is formed an inclined guide surface 17 which is used to facilitate an engaging operation between the securing portion 13 and a receive portion 34 formed in the second terminal metal fitting 30 to be discussed later. Between the displacement restriction portion 15 and the two plate-like overlap portion 12A, 12B, there are formed escape grooves 18 into which connecting portions between the two plate-like overlap portions 32A, 32B of the second terminal metal fitting 30 and a receive portion 34 formed in the second terminal metal fitting 30 can be inserted.

In the upper surface of the receive portion 14, there is formed a securing hole 19 which can be engaged with a securing claw 36 provided in the second terminal metal fitting 30. The receive portion 14 further includes a projecting portion 20 which is set flush with the receive portion 14 and extends toward the displacement restriction portion 15 and, in the upper surface of the projecting portion 20, there is formed an inclined guide surface 21 which is used to facilitate the fitting operation of the securing hole 19 with the securing claw 36 of the second terminal metal fitting 30. Also, between the projecting portion 20 and the two plate-like overlap portions 12A, 12B, there are formed escape groove into which connecting portions 33A existing between a securing portion 33 and two plate-like overlap portions 32A, 32B respectively formed in the second terminal metal fitting 30 can be retreated.

The mutually opposed edges of the securing portion 13 and projecting portion 20 are respectively formed as arc-shaped edges which are concentric with each other and equal in diameter to each other. Also, the two plate-like overlap portions 12A and 12B of the first terminal metal fitting 10 are arranged in such a manner that the side edges thereof can be in contact with virtual circles which are respectively concentric and equal in diameter with such arcs. Further, a space enclosed by these edges provides an insertion hole 23 into which a tightening bolt 50 can be fitted.

An electric wire connecting portion 24 is formed integrally with the above-mentioned assembling portion 11. That is, the electric wire connecting portion 24 is arranged in such a manner that it extends from the end portion side edge of the plate-like overlap portion 12B on the receive portion 14 side thereof toward a direction at right angles to the longitudinal direction of the plate-like overlap portion 12B. The electric wire connecting portion 24 includes an insulation barrel 24A and a wire barrel 24B. The insulation barrel 24A is crimped from the side of the associated equipments (not shown) on a resin cover Wa provided in the terminal portion of a ground wire W, whereas the wire barrel 24B is crimped on a core wire Wb which is exposed by peeling off the resin cover Wa of the ground wire W.

(Structure of Second Terminal Metal Fitting)

Now, to produce the second terminal metal fitting 30, as in the first terminal metal fitting 10, a conductive metal plate is punched out into a given shape and the thus punched metal plate is then bent, so that it includes an assembling portion 31 and an electric wire connecting portion 44. The assembling portion 31 has a structure in which the assembling portion 11 of the first terminal metal fitting 10 is turned upside down. That is, the plate-like overlap portion 32 (a plate-like overlap portion disposed on far side to the electric wire connecting portion 44 in FIG. 1 is referred to as 32A, whereas a plate-like overlap portion on the near side thereto in FIG. 1 is referred to as 32B, hereinafter) of the assembling portion 31 can be overlapped with the lower surface sides of the plate-like overlap portions 12A and 12B of the first terminal metal fitting 10, respectively; and, the securing portion 33 and receive portion 34 of the assembling portion 31 can be overlapped with the upper surface sides of the receive portion 14 and securing portion 13 of the first terminal metal fitting 10, respectively. In the assembling portion 31 of the second terminal metal fitting 30 as well, there are formed a displacement restriction portion 35 and a securing claw 36 in the securing portion 33 and, there are formed a securing hole 39 and a projecting portion 40 in the receive portion 34. Further, there is formed an insertion hole 43 which is identical with the insertion hole 23 of the first terminal metal fitting 10 and there are formed escape grooves 38 and 42 respectively between the displacement restriction portion 35 and two plate-like overlap portions 32A, 32B as well as between the projecting portion 40 and two plate-like overlap portions 32A, 32B.

In addition, the electric wire connecting portion 44, similarly to the electric connecting portion 24 of the first terminal metal fitting 10, includes an insulation barrel 44A and a wire barrel 44B which are crimped on a ground wire W. The electric wire connecting portion 44 is arranged in such a manner that it extends from the end portion side edge of the plate-like overlap portion 32B on the receive portion 34 side thereof in a direction at right angles to the longitudinal direction of the plate-like overlap portion 32B. Therefore, when the second terminal metal fitting 30 is assembled with the first terminal metal fitting 10, the electric wire connecting portion 44 can be arranged in parallel to the electric wire connecting portion 24 of the first terminal metal fitting 10.

Next, description will be given below of a structure for increasing a contact pressure between the two terminal metal fittings 10 and 30 to be assembled. As described above, the second terminal metal fitting 30 includes the two plate-like overlap portions 32A and 32B. On the upper surface of the plate-like overlap portion 32A that is arranged on far side to the electric wire connecting portion 44 in FIG. 1, there is formed by punching a projecting portion 45 (that is, a pressing portion which is the subject matter of the present invention) which extends along the longitudinal direction of the overlap portion 32A (that is, a direction in which the two terminal metal fittings are assembled). In addition, the projecting portion 45 is formed in vicinity of the tip portion of the plate-like overlap portion 32A and, when the first and second terminal metal fittings 10 and 30 are assembled together, is situated outside of a position where the head portion 50A of the tightening bolt 50 is directly pressed against the first terminal metal fitting 10, that is, outside of a position which is an area A shown by meshes in FIG. 3. Therefore, tightening by the tightening bolt 50 is executed on an area existing inside of the projecting portion 45 and is not executed directly on the projecting portion 45 itself. Moreover, the height of the projecting portion 45 is set in such a manner that, when the securing portions 13, 33 and receive portions 14, 34 are in contact with each other, the top portion of the projecting portion 45 is higher than the height of the lower surface of the plate-like overlap portion 12A of the first terminal fitting member 10. Further, when the two terminal metal fittings 10 and 30 are assembled together, inside of the projecting portion 45, there can be formed a slight clearance 41 (see FIG. 4) between the two plate-like overlap portions 12A and 32A.

(Operation of the Present Embodiment)

Now, description will be given below of a procedure for assembling together the above-mentioned first and second terminal metal fittings 10 and 30. At first, the first terminal metal fitting 10 is assembled with the second metal fitting 30. To assemble the first terminal metal fitting 10 with the second metal fitting 30, the first terminal metal fitting 10 is disposed above the second metal fitting 30 and the securing portions 13 and 33 thereof are respectively inserted into their mating insertion holes 43 and 23. From this condition, the securing portions 13 and 33 are further slided in the longitudinal direction of the plate-like overlap portions 12 and 32 (which is hereinafter referred to as an assembling direction) so that the insertion holes 23 and 43 can be matched to each other. As a result of this, the displacement restriction portion 15 of the first terminal metal fitting 10 is arranged under the receive portion 34 of the second terminal metal fitting 30 and, at the same time, the displacement restriction portion 35 of the second terminal metal fitting 30 is arranged onto the receive portion 14 of the first terminal metal fitting 10. After then, the securing claws 16 and 36 are respectively fitted with the securing holes 19 and 39, which completes the assembling operation of the two terminal metal fittings 10 and 30 (see FIG. 2). In this condition, not only the engagement between the securing claws 16, 36 and securing holes 19, 39 prevents the two terminal metal fittings 10 and 30 against removal in the opposite direction to the assembling direction, but also the contact between the respective depth portions of the escape grooves 18, 42 and 22, 38 prevents the two terminal fitting members from being assembled together in an excessive manner beyond the normal assembling position thereof. In addition, since the projecting portion 45 of the second terminal metal fitting 30 pushes up the plate-like overlap portion 12A of the first terminal metal fitting 10, the securing portions 13, 33 and receive portions 14, 34 are shifted in a direction where they can be closely contacted with each other, so that the securing claws 16 and 36 can be engaged with the securing holes 19 and 39 more closely. Further, in a state in which the two terminal metal fittings 10 and 30 are overlapped with each other, inside of the projecting portion 45, there is formed a slight clearance 41 between the two plate-like overlap portions 12A and 32A.

After then, the tightening bolt 50 is inserted into the insertion holes 23 and 43 of the two terminal metal fittings 10 and 30 which have been assembled together, and the two assembled terminal metal fittings 10 and 30 are then fastened tight by the tightening bolt 50 in the direction of a vehicle body 51. As the two terminal metal fittings 10 and 30 are fastened tight by the tightening bolt 50, the respective plate-like overlap portions 12 and 32 of the two terminal metal fittings 10 and 30 are brought into contact with each other and the second terminal metal fitting 30 is pressed against the vehicle body 51 side. During this operation, the portion of the plate-like overlap portion 12A of the first terminal metal fitting 10 that is situated inside of the portion against which the projecting portion 45 is butted, that is, the portion of the plate-like overlap portion 12A that forms the clearance 41 with respect to the plate-like overlap portion 32A of the second terminal metal fitting 30 is flexibly deformed and is pressed in a direction where it approaches the plate-like overlap portion 32A of the second terminal metal fitting 30 (see FIG. 4). And, if the tightening of the two metal fittings 10 and 30 by the tightening bolt 50 advances further, then a resilient force generated due to the flexibly deformed plate-like overlap portion 12A is applied onto the butting portion of the projecting portion 45, so that the plate-like overlap portions 12A and 32A are strongly pressed against each other through the projecting portion 45. That is, the two terminal metal fittings 10 and 30 are not only pressed against each other by a tightening force given directly from the tightening bolt 50, but they are also strongly contacted with each other by the resilient force that is generated by flexibly deforming the plate-like overlap portion 12A of the first terminal metal fitting 10 (see FIG. 5).

(Effects of the Present Embodiment)

As described above, according to the present embodiment, since the provision of the projecting portion 45 makes it possible to increase the contact pressure between the two terminal metal fittings 10 and 30, there can be secured reliability on the contact between the two terminal metal fittings 10 and 30 assembled. Also, in the present embodiment, the contact pressure between the two terminal metal fittings 10 and 30 is increased by fastening the areas of the two terminal metal fittings 10 and 30 situated inside of the projecting portion 45, but the projecting portion 45 is not tightened directly. Due to this, even if the tightening bolt 50 is tightened excessively, the projecting portion 45 can be prevented from being deformed or damaged.

Further, according to the present embodiment, in a state in which the two terminal metal fittings 10 and 30 are simply assembled together, that is, in a state before the two terminal metal fittings 10 and 30 are fastened tight against each other by the tightening bolt 50, the projecting portion 45 pushes up the plate-like overlap portion 12A of the first terminal fitting member 10 to thereby be able to bring the securing claws 16 and 36 into closer contact with the securing holes 19 and 39. This can solve a problem that the two terminal metal fittings can become loose with respect to each other in the initially assembled stage thereof, which results in the enhanced reliability on the initial assembled condition of the two terminal metal fittings. Also, since the contact condition of the two terminal metal fittings can be always kept in the pressing or projecting portions thereof, the conduction reliability between the two terminal metal fittings can also be enhanced.

(Other Embodiments)

However, the invention is not limited to the embodiment discussed in the foregoing description with reference to the accompanying drawings but, for example, the following embodiments also fall within the technical scope of the invention. Further, other various embodiments and modifications are also possible without departing from the scope of the subject matter of the invention.

(1) Although the projecting or pressing portion 45 is formed by punching in the illustrated embodiment, it can also be formed by cutting and raising the plate-like overlap portion.

(2) In the illustrated embodiment, the projecting portion 45 is formed in a shape which extends in the longitudinal direction of the plate-like overlap portion (that is, a direction in which the two terminal metal fittings are assembled together). However, the projecting portion can also be composed of, for example, a dimple. In this case, a single dimple may be formed or a plurality of dimples may be arranged.

(3) In the illustrated embodiment, the projecting portion 45 is provided only in the second terminal metal fitting 30. However, according to the invention, the projecting portion can also be provided only in the first terminal metal fitting, or can be formed in both the first and second terminal metal fittings.

(4) In the illustrated embodiment, description has been given of a case in which the invention is applied to a terminal metal fitting assembling structure of a type that the two terminal metal fittings 10 and 30 are assembled together by sliding them along the plate surfaces of the plate-like overlap portions 12 and 32 thereof. However, this is not limitative but the invention can also be applied to an assembling structure of a type that it includes only insertion holes through which a bolt can be inserted, an assembling structure of a type that insertion holes are firstly matched to each other and two terminal metal fittings are then rotated about the insertion holes with respect to each other so that the two terminal metal fitting can be assembled together, or the like.

(5) In the illustrated embodiment, the tightening bolt 50 is inserted through the insertion holes 23 and 43 of the two assembled terminal metal fittings 10 and 30 and the two terminal metal fittings 10 and 30 are then tightened to the vehicle body 51 by the tightening bolt 50. According to the invention, however, this is not limitative but, for example, a bolt may be provided in such a manner that it projects out from the vehicle body, two assembled terminal metal fittings may be placed over the bolt and, after then, the two terminal metal fittings may be tightened by a nut.

(6) In the illustrated embodiment, the projecting or pressing portion 45 according to the invention is disposed outside of the area A against which the head portion 50A of the tightening bolt 50 is directly pressed. However, when the tightening bolt 50 is inserted through a washer, the projecting portion 45 may be formed in such a manner that it is disposed outside of an area against which the washer is directly pressed. In short, the projecting or pressing portion may be formed outside of an area with which a fastening member such as a bolt, a nut, a washer or the like is directly contacted.

(7) In the illustrated embodiment, description has been given of a case in which the two terminal metal fittings 10 and 30 are assembled together. However, this is not limitative but the present invention can also be applied to a case in which three or more terminal metal fittings are assembled together.

(8) In the illustrated embodiment, description has been given of a case in which the invention is applied to the two terminal metal fittings 10 and 30 for grounding. However, the present invention can also be applied to terminal metal fittings for use in other uses than grounding.

What is claimed is:

1. A terminal metal fitting assembling structure, comprising:

a first terminal metal fitting having a first surface with a first direct contact portion and a first resilient contact portion, and a first opening formed in the first surface;

a second terminal fitting having a second surface with a second direct contact portion and a second resilient contact portion, and a second opening formed in the second surface, at least one of the first and second surfaces having a projecting portion formed on the respective resilient contact portion, the projecting portion maintaining a clearance between the first surface and the second surface when the first terminal metal fitting and the second terminal metal fitting are overlapped; and a tightenable fastener that passes through the first and second openings and fastens the overlapped first and second terminal fittings together, the tightenable fastener having a head portion that substantially overlaps the first and second direct contact portions, the first and second direct contact portions extending at least from the first and second openings, respectively, to outer perimeters of respective areas of the first and second surfaces overlapped by the head portion;

wherein, in a fastened state of the first and second terminal metal fittings, the first and second direct contact portions are in direct contact and the first and second resilient contact portions are in contact via the projecting portion.

2. The terminal metal fitting assembling structure according to claim 1, wherein said first metal fitting has a first engaging portion on the first surface, and said second metal fitting has a second engaging portion on said second surface to be engaged with said first engaging portion when said first and second metal fittings are overlapped with each other, and further wherein in a condition that said first and second metal fittings are overlapped with each other before said first and second metal fittings are tightly fastened by said tightenable fastener; said first terminal metal fitting is pushed away from said second terminal metal fitting by said projecting portion, so that said first and second metal fittings are forced in a direction where said first and second engaging portions are contacted closely with each other.

3. The terminal metal fitting assembling structure according to claim 2, wherein at least one of said first and second engaging portions has at least one securing hole, and at least one of said first and second receiving portions has at least one securing claw which engages with said at least one securing hole when said first and second metal fittings are overlapped with each other.

4. The terminal metal fitting assembling structure according to claim 3, said first metal fitting further comprising:

two first plate-like overlap portions in parallel to each other and spaced apart from each other;

a first securing portion disposed between the two first plate-like overlap portions; and a first recording portion disposed between the two first plate-like portions and arranged opposite to said first securing portion, and said second metal fitting further comprising:

two second plate-like overlap portions in parallel to each other and spaced apart from each other;

a second securing portion disposed between the two second plate-like overlap portions for being overlapped with said first receiving portion; and a second receiving portion disposed between the two second plate-like overlap portions and arranged opposite to said second securing portion for being overlapped with said first securing portion, and wherein said first receiving portion has an inclined guide surface which facilitates moving of said at least one securing claw toward said at least one securing hole when one of said first and second terminal metal fitting displaces in an assembling direction to be overlapped with the other thereof.

5. The terminal metal fitting assembling structure according to claim 3, each of said first and second terminal metal fittings further comprising:

escape grooves formed between said receiving portion and two plate-like overlap portions and between said securing portions and two plate-like overlap portions to assemble said first and second metal fittings in a normal assembling portion when said first and second metal fittings are overlapped.

6. The terminal metal fitting assembling structure according to claim 1, wherein the first and second terminal metal fittings each further comprise a first edge portion having an electric wire connecting portion formed thereon and a second edge portion located at a position that is rotated at least 90° from the first edge portion, and wherein the projecting portion is positioned near the second edge portion.

7. The terminal metal fitting assembling structure according to claim 6, wherein the second edge portion is located at a position that is rotated substantially 180° from the first edge portion.

* * * * *